US008882335B2

(12) United States Patent
Gencer

(10) Patent No.: US 8,882,335 B2
(45) Date of Patent: Nov. 11, 2014

(54) METHOD AND SYSTEM FOR RECYCLING RIPPED ASPHALT INTO NEW ASPHALT PRODUCTION

(75) Inventor: Mehmet Nezir Gencer, Bursa (TR)

(73) Assignee: E-Mak Makine Insaat Ticaret Ve Sanayi Anonim Sirketi (TR)

( * ) Notice: Subject to any disclaimer, the term of this patent is extended or adjusted under 35 U.S.C. 154(b) by 1161 days.

(21) Appl. No.: 12/680,020

(22) PCT Filed: Jan. 21, 2008

(86) PCT No.: PCT/TR2008/000007

§ 371 (c)(1),
(2), (4) Date: Mar. 25, 2010

(87) PCT Pub. No.: WO2009/058103

PCT Pub. Date: May 7, 2009

(65) Prior Publication Data

US 2010/0203462 A1 Aug. 12, 2010

(30) Foreign Application Priority Data

Sep. 27, 2007 (TR) ..... a 2007/06652
Dec. 3, 2007 (TR) ..... a 2007/08336

(51) Int. Cl.
*B28C 5/46* (2006.01)
*E01C 19/10* (2006.01)

(52) U.S. Cl.
CPC ..... *E01C 19/1004* (2013.01)
USPC ..... 366/18; 366/22; 432/140

(58) Field of Classification Search
USPC ..... 366/7, 18, 22–25, 141, 148; 432/140, 432/121, 130, 186
See application file for complete search history.

(56) References Cited

U.S. PATENT DOCUMENTS 3,386,435 A * 6/1968 Heller ..... 126/343.5 A
3,484,083 A * 12/1969 Albertini ..... 366/22
3,577,976 A * 5/1971 Heller ..... 126/343.5 A
4,136,964 A * 1/1979 Swisher, Jr. ..... 366/23
4,256,414 A * 3/1981 Milligan ..... 404/79

(Continued)

FOREIGN PATENT DOCUMENTS

FR 2755450 A1 5/1998
FR 2866037 A1 8/2005

OTHER PUBLICATIONS

International Search Report for PCT/TR2008/000007: Jun. 16, 2008; 2 pgs.

*Primary Examiner* — Charles Cooley
(74) *Attorney, Agent, or Firm* — Gardner Groff Greenwald & Villanueva, PC

(57) ABSTRACT

The invention relates to a hot asphalt recycling system for adding any used and then ripped asphalt from its original place into new asphalt production, having a heat-insulated frame with a closed volume; at least one RAP material transmission channel within frame, transmission channel being embodied so as to produce a geometrical shape with at least three edges; a transmission line displacing within the RAP material transmission channel and comprising a plurality of transmission plates positioned thereon at certain intervals; optionally a feeding mechanism feeding RAP material to transmission line at a certain speed; an accumulation reservoir formed within frame to store the RAP material heated to a certain temperature without causing any temperature fall; optionally a discharge mechanism providing the transfer of accumulated hot RAP material; and optionally a discharge unit to discharge the RAP material within the transmission line to the exterior when it becomes necessary.

20 Claims, 5 Drawing Sheets

(56) References Cited

U.S. PATENT DOCUMENTS 4,418,682 A * 12/1983 Heller ..... 126/343.5 A
4,445,848 A * 5/1984 Heller ..... 432/13
4,483,620 A * 11/1984 Shinohara et al. ..... 366/7
4,695,186 A * 9/1987 King ..... 404/111
5,120,217 A * 6/1992 O'Brien et al. ..... 432/120
5,251,976 A * 10/1993 Milstead ..... 366/18
5,277,490 A * 1/1994 Boon ..... 366/4
5,291,876 A * 3/1994 Milstead ..... 126/343.5 A
5,590,976 A * 1/1997 Kilheffer et al. ..... 404/72
7,384,181 B1 * 6/2008 Collette ..... 366/7
7,758,235 B1 * 7/2010 Collette ..... 366/7
2010/0203462 A1 * 8/2010 Gencer ..... 432/86

* cited by examiner

METHOD AND SYSTEM FOR RECYCLING RIPPED ASPHALT INTO NEW ASPHALT PRODUCTION

CROSS-REFERENCE TO RELATED APPLICATIONS

This application is a U.S. National Phase patent application of PCT/TR2008/000007 filed Jan. 21, 2008, which claims the benefit of TR 2007/06652 filed Sep. 27, 2007 and TR 2007/08336 filed Dec. 3, 2007, the entireties of which are hereby incorporated herein by reference for all purposes.

FIELD OF INVENTION

The present invention relates to a system and method, providing recycling of removed asphalt pavement from its existing place so as to be used in the new hot mix asphalt production.

The present invention more particularly relates to a hot asphalt recycling system, in which removed reclaimed asphalt pavement to be subjected to recycling is first crushed and sieved, then subjected to size-based separation if necessary, then is heated, stored so as to maintain its temperature, and optionally transported to the asphalt plant in an automatic manner.

BACKGROUND OF INVENTION AND KNOWN APPLICATIONS

As a known fact in the relevant background art, the top surface course on the base is realized on the road's foundation by applying asphalt concrete mixed with bitumen according to various methods (hot mix, warm mix, etc.) in the form layers with differing characteristics one layer on the other. Each asphalt concrete layer has differing performances and is obtained by mixing aggregates provided by breaking off natural stones with bitumen in certain proportion according to standard design methods. The asphalt layers and particularly the surface layer (i.e. the wear course) making up the road's top surface course have certain lifespan. Any such layers with expired lifespan or which must be renewed as it becomes nonfunctional due to deformation under various influences must be ripped from the place it was already paved. Any such asphalt to be recycled and therefore subjected to this operation is named as RAP, i.e. Reclaimed Asphalt Pavement, while the asphalt recycled as a result of various methods to be detailed hereinafter is designated as Recycled Asphalt Concrete, i.e. RAC.

The procurement of aggregate from mines which are rarely found in many regions of the world but particularly in the Europe continent, the transport of such aggregate to production facilities and their processing brings about high costs. The other raw material, i.e. the bitumen, used in producing the asphalt concrete is obtained from petroleum. The recycling of removed reclaimed asphalt pavement (to be referred to hereinafter as RAP, or RAP material) removed from its original place instead of discarding it brings economical and environmental advantages with respect to reducing the raw material supply costs for producing asphalt concrete, the efficient use of natural sources (e.g. aggregate and bitumen) consumed in relevant processes, and eliminating the cost of management of any such removed reclaimed asphalt pavements as a constructional waste material.

Depending on available conditions, it is possible to pave back the RAP material to its original place by implementing a process bringing it back to a reusable condition at the site of removal (i.e. in situ recycling). In some other circumstances, it is dismantled and transported away from the original place so as to be admixed into new hot asphalt concrete mixture prepared at the asphalt plant where fresh asphalt concrete is produced. Before being admixed, it can be subjected to breaking-off and/or sieving operation(s) and be classified with respect to aggregate size so that its admixture will not deteriorate the desired specifications (the mixture gradation, bitumen rate, etc.) of the fresh hot asphalt concrete mixture.

RAP material, which is already classified according to the aggregate size may be added in the cold form to the new hot asphalt concrete mixture (i.e. cold recycling), in this case however, the addition proportion may become restricted. Since any such ripped asphalt added in the cold form will drop down the temperature of the new mix, the proportion in which the ripped asphalt is added must be kept at lower levels.

The most efficient way of producing a new hot asphalt concrete mix with the highest RAP proportion possible is to heat RAP before adding it into the mix. If the RAP material is to be heated and fed into the asphalt plant in an amount (tones/hour) required for the new mixture, it is possible to produce the new mix from 100% of RAP material.

Because of both economical and environmental factors referred to hereinabove, the intention for producing a new hot mix asphalt by means of a maximum RAP material proportion becomes very understandable.

Although the systems enabling the addition of RAP material in a hot form into the new mix allows to a relatively higher mixture proportion for RAP, the maximization of this proportion is difficult due to some drawbacks of current technologies. Put differently in a more detailed manner, RAP material becomes sticky as it is heated before fed into the mix because of the bitumen contained therein, and becomes adhered to the walls of means (drum, elevator, etc.) wherein it is heated and transferred to the new mix. Since it becomes adhered and coated to the inner walls of such heating and transfer means, the internal volume of such means becomes diminished following each use. Thus, even if the RAP material accumulated in such means can partially be cleaned, it nevertheless causes a substantial reduction in the system's efficiency and capacity; in other words, the amount of RAP material supplied to the new mix becomes gradually reduced so that the system's capacity becomes lower and lower or even entirely blocked.

Despite the fact that mixing RAP material into the new mix provides some advantages, the difficulties experienced in maximizing the admix proportion of RAP material in producing new asphalt require an improvement be made in the relevant technical field.

DESCRIPTION OF INVENTION

The present invention relates to a novel asphalt recycling system, eliminating aforesaid problems and brining new advantages to the relevant technical field.

The main objective of the present invention is to increase the efficiency of hot recycling of any used and then removed and reclaimed asphalt pavement from its original place (RAP material) in producing new asphalt as compared to equivalent approaches.

Another objective of the present invention, under the main objective, is to produce a hot asphalt recycling system wherein the temperature of air circulated within the channel to heat the RAP material is adjusted over a large interval. Thanks to this feature, the amount of heat transferred from hot air to bring the temperature of RAP material to the process temperature is accurately adjusted with respect to the amount of RAP material to be heated in the system, the inlet temperature of RAP material, the external temperature, etc.

A further objective of the present invention is to produce a hot mix asphalt recycling system, wherein the discharge to the exterior of any processed RAP material in the hot mix asphalt recycling system and thus the amount of such discharged material are controlled in an accurate manner. In this manner, the RAP material is weighed on a load-cell and supplied into the mixer according to the weight of each batch to be produced in the mixer and the proportion of RAP material to be added to said batch. On the other hand, the proportion of RAP material to be added to a new mix is determined according to predetermined characteristics of the new mix and the RAP material stored at silos. The amount of RAP material ensuring such determined mix proportion is transferred from the silo to the mixer by means of a whorl conveyor.

In order to achieve all aforementioned objectives, the present invention provides a hot asphalt recycling system for adding any used and then ripped asphalt from its original place into new asphalt production, said system characterized by comprising a heat-insulated frame with a closed volume; at least one RAP material transmission channel within said frame, said channel being embodied so as to produce a geometrical shape with at least three edges; a transmission line displacing within said RAP material transmission channel and comprising a plurality of transmission plates positioned thereon at certain intervals; an optional feeding mechanism feeding RAP material to said transmission line; heating means used to heat the RAP material in the transmission line to a certain temperature; a actuation mechanism to displace said transmission line at a certain speed; an accumulation reservoir formed within said frame to store the RAP material heated to a certain temperature without causing any temperature fall; an optional discharge mechanism providing the transfer of accumulated hot RAP material to a desired means; and an optional discharge unit to discharge the RAP material within the transmission line to the exterior when necessary.

In a preferred embodiment of the present invention, said heating means comprise a hot air circulation channel surrounding said transmission channel from the interior and/or exterior, and a hot air generation mechanism used for providing hot air to be circulated at a desired flow rate and speed within said hot air circulation channel.

In another preferred embodiment of the present invention, said hot air generation mechanism includes further a precombustion chamber, fan, and boiler.

In a further preferred embodiment of the present invention, said hot air generation mechanism comprises cold air supplying means in order to control the temperature of generated hot air.

In another preferred embodiment of the present invention, said cold air supplying means is a flap, which is placed at the inlet of the hot air channel, is opened and closed so as to increase/decrease the cross-section of said cold air inlet channel, and is composed of plurality small flaps.

In a further preferred embodiment of the present invention, said small flaps have the form of wings disposed in sequence along the inner wall of said cold air inlet channel so as to narrow and enlarge the channel by rotating around multiple connection axes.

In another preferred embodiment of the present invention, the opening and closing of said small flaps is controlled by means of an automation system.

In a further preferred embodiment of the present invention, said transmission line and thus the hot air circulation channel have a form resembling the form of a right-angled triangle.

In another preferred embodiment of the present invention, a hot air reservoir is provided at the region where the hypotenuse edge of said transmission line is present, so that the hot air that completes the circulation within the hot air channel is supplied into said reservoir.

In a further preferred embodiment of the present invention, said hot air reservoir comprises a plurality of small guiding wings that lengthen the way to be traveled by hot air within the hot air reservoir so that heat transfer is provided to the transmission channel and the RAP material accumulation reservoir and that divert the hot air which becomes polluted with the emerging steam and gases to the air outlet pipe.

In another preferred embodiment of the present invention, a whorl conveyor is used as said supplying mechanism.

In a further preferred embodiment of the present invention, said actuation mechanism comprises at least one electric motor and reducer and a plurality of chain gears coupled to said motor and reducer and a plurality of chains which are rotated by means of these chain gears and positioned so as to rotate in turn within the transmission line.

In another preferred embodiment of the present invention, a whorl conveyor is as a discharge mechanism and optionally, a discharge shutter is used that is embodied at the base of said accumulation reservoir.

In another preferred embodiment of the present invention, said discharge mechanism comprises weighing means equipped with weight sensors in order to ensure the addition of processed RAP material within the system into the new mix at a desired proportion.

In a further preferred embodiment of the present invention, said weighing means comprises at least one discharge outlet wherein hot RAP material output from the material accumulation reservoir is discharged, weight sensors measuring the weight of the material filled into said discharge outlet, closing means closing the discharge shutter once the material is discharged and weighed to a desired weight, and a whorl cylinder to transfer the material released from the discharge shutter to the mixer.

In another preferred embodiment of the present invention, said material accumulation reservoir is embodied so as to make an outward projection from one side of said frame so that the reservoir discharge outlet becomes aligned with said discharge reservoir.

In a further preferred embodiment of the present invention, a hot air channel is comprised that is embodied in an insulated manner so as to adequately wrap the outward projecting part of the reservoir from the exterior in order to avoid any temperature drop in the accumulation reservoir.

In another preferred embodiment of the present invention, said hot air channel—wherein hot air generated by the hot air generation mechanism—is positioned on the outer wall of the discharge reservoir so that insulation is ensured to prevent any heat loss.

In a further preferred embodiment of the present invention, said frame is in the form of a right-angled triangle so as to fit the transmission line and hot air circulation channel.

In another preferred embodiment of the present invention, said frame is positioned on support legs in an available asphalt plant in order to transfer hot RAP material output from the discharge mechanism to the mixer of the asphalt plant.

In a further preferred embodiment of the present invention, the RAP material to be recycled for addition into a new mix is conveyed to said feeding mechanism by means of a vertical bucket elevator.

In another preferred embodiment of the present invention, an aspiration system and filter are provided at the end of the channel in order to safely release to the atmosphere the hot air which becomes polluted due to steam and gases emerging as a result of heat within said hot air reservoir, and is then guided to the air outlet channel by means of guiding wings.

In a further preferred embodiment of the present invention, said discharge mechanism comprises at least one shutter positioned at the lowermost point of the transmission channel and an optional whorl conveyor, in order to discharge for any reason any processed asphalt before arriving the accumulation reservoir.

Another aspect of the present invention provides a hot asphalt recycling method to ensure the recycling and reutilization of bituminous asphalt concrete ripped for any reason from its original place of application, comprising the steps of A hot mix asphalt recycling method ensuring the recycling and reutilization of bituminous asphalt concrete removed for any reason from its original place of application, comprising the steps of a) providing an environment which is adequately heat-insulated from the exterior,
b) displacing on a given direction and transferring the RAP material within said environment,
c) providing heat transfer to the RAP material along the line of displacement by means of hot surfaces and hot air contact during displacement, thus achieving a desired process temperature for recycling,
d) transferring said heated asphalt material to an accumulation reservoir within said heat-insulated environment,
e) discharging to exterior the material within said accumulation reservoir once it is accumulated to an adequate amount, and
f) transferring such RAP material to another environment from the lowermost point of the transmission channel (2.1) before arriving the silo, when it becomes necessary for any reason to discharge said material.

In a preferred implementation of the subject method, the asphalt material is displaced on a direction in a closed geometrical form with at least three edges in step (b), and accordingly in step (c), the hot air is circulated in the line having said geometrical form. Said direction preferably defines a form that resembles the shape of a right-angled triangle.

In another preferred implementation of the subject method, the heating air which becomes polluted with steam and gases in said means is discharged to the exterior after being passed through a filter in said step (d).

In a further preferred implementation of the subject method, the discharge mechanism of said heat-insulated means is adapted so as to carry out discharging to the mixer of the asphalt plant in step (a).

In another preferred implementation of the subject method, the desired process temperature in step (c) is between 140° C. and 180° C.

The present invention is to be evaluated together with annexed figures briefly described hereunder to make clear the subject embodiment and the advantages thereof.

REFERENCE NUMBERS OF PARTS IN FIGURES

1. Loading unit
- 1.1. Silo
- 1.2. Band conveyor
- 1.3. Vertical bucket elevator unit

2. Frame
- 2.1. Transmission channel
  - 2.1.1. Enlarging point
- 2.2. Hot air reservoir
  - 2.2.1. Upper guiding wing
  - 2.2.2. Central guiding wing
  - 2.2.3. Lower guiding wing
- 2.3. Transmission line
  - 2.3.1. Transmission plates
  - 2.3.2. Chains
  - 2.3.3. Chain gears
  - 2.3.4. Electric motor and reducer
- 2.4. Air circulation channel
  - 2.4.1. Air inlet pipe
  - 2.4.2. Air outlet pipe
  - 2.4.3. Intermediary transfer pipe
- 2.5. Feeding reservoir
- 2.6. Feeding mechanism
- 2.7. RAP material accumulation reservoir
  - 2.7.1. Protective surface
  - 2.7.2. Discharge outlet shutter
  - 2.7.3. Discharge outlet
  - 2.7.4. Hot air channel
- 2.8. RAP material discharge mechanism
- 2.9. Discharge unit
- 2.10. RAP material discharge channel

3. Hot air generation mechanism
- 3.1. Boiler
- 3.2. Air adjustment flaps
- 3.3. Cold air channel
- 3.4. Hot air channel
- 3.5. Pre-combustion chamber
- 3.6. Fan
- 3.7. Hot air inlet channel

4. RAP material weighing mechanism
- 4.1. Discharge reservoir
- 4.2. Discharge shutter
  - 4.2.1. Shutter pistons
- 4.3. Transfer surface
- 4.4. Whorl cylinder frame
- 4.5. Whorl cylinder
- 4.6. Cylinder discharge outlet

5. Asphalt plant
- 5.1. Mixer

DETAILED DESCRIPTION OF INVENTION

In the following detailed description, the subject of hot mix asphalt recycling system hot air recycling system shall be described illustratively by making references to annexed figures, only to make it clear without imposing any restrictions thereon.

Figure 1:
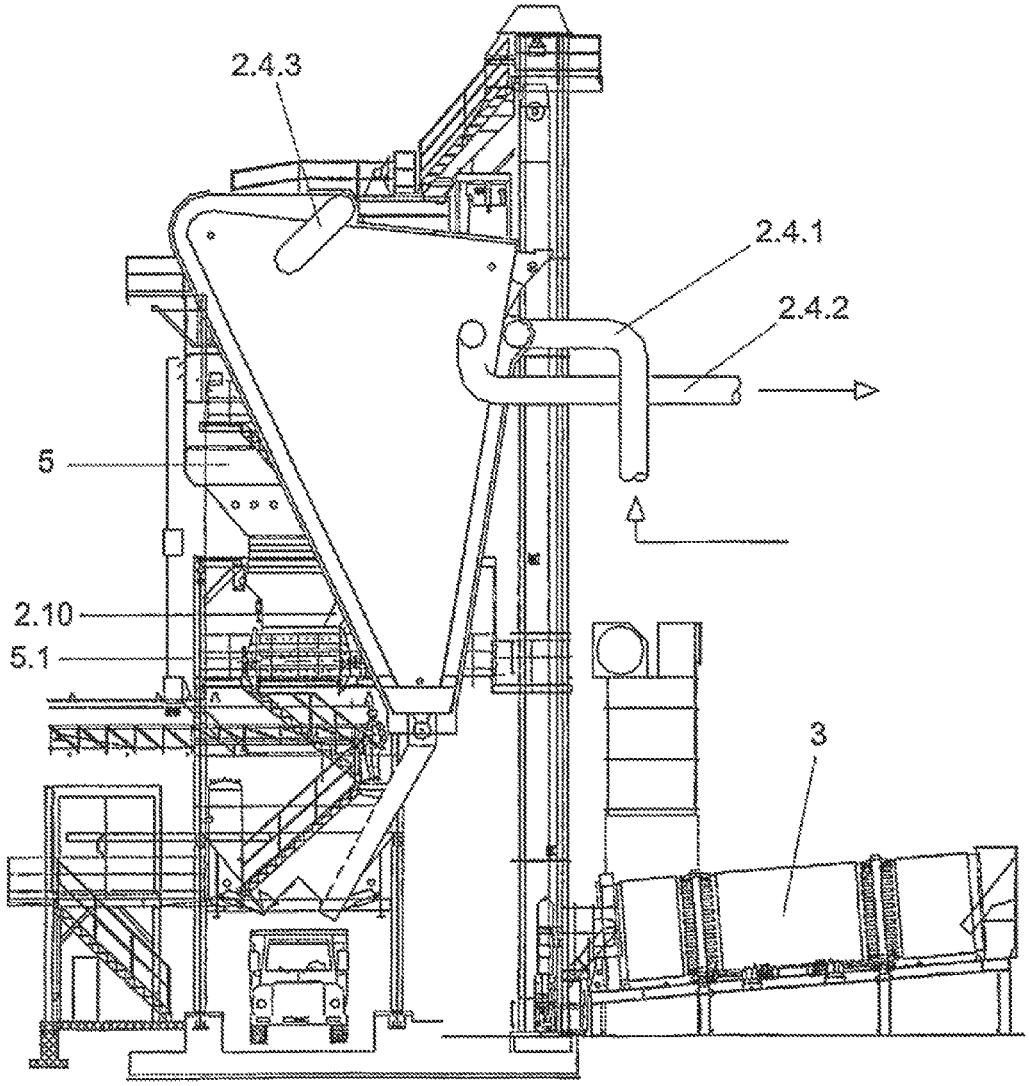
FIG. 1 gives a front view of the subject hot mix asphalt recycling system together with an asphalt plant.

As illustrated in FIG. 1, the equipments of asphalt production for road construction comprises in the most general sense an asphalt plant (5) including a mixer (5.1) whereby the aggregate is mixed with bitumen, and a hot asphalt recycling system, which is erected aside said asphalt plant (5) to process the RAP material that is to be recycled for reutilization and thus is fed into the mixer (5.1). This Figure illustrates also the RAP material discharge channel (2.10), which provides the transfer of RAP material output from the recycling system to the mixer (5.1).

Figure 2:
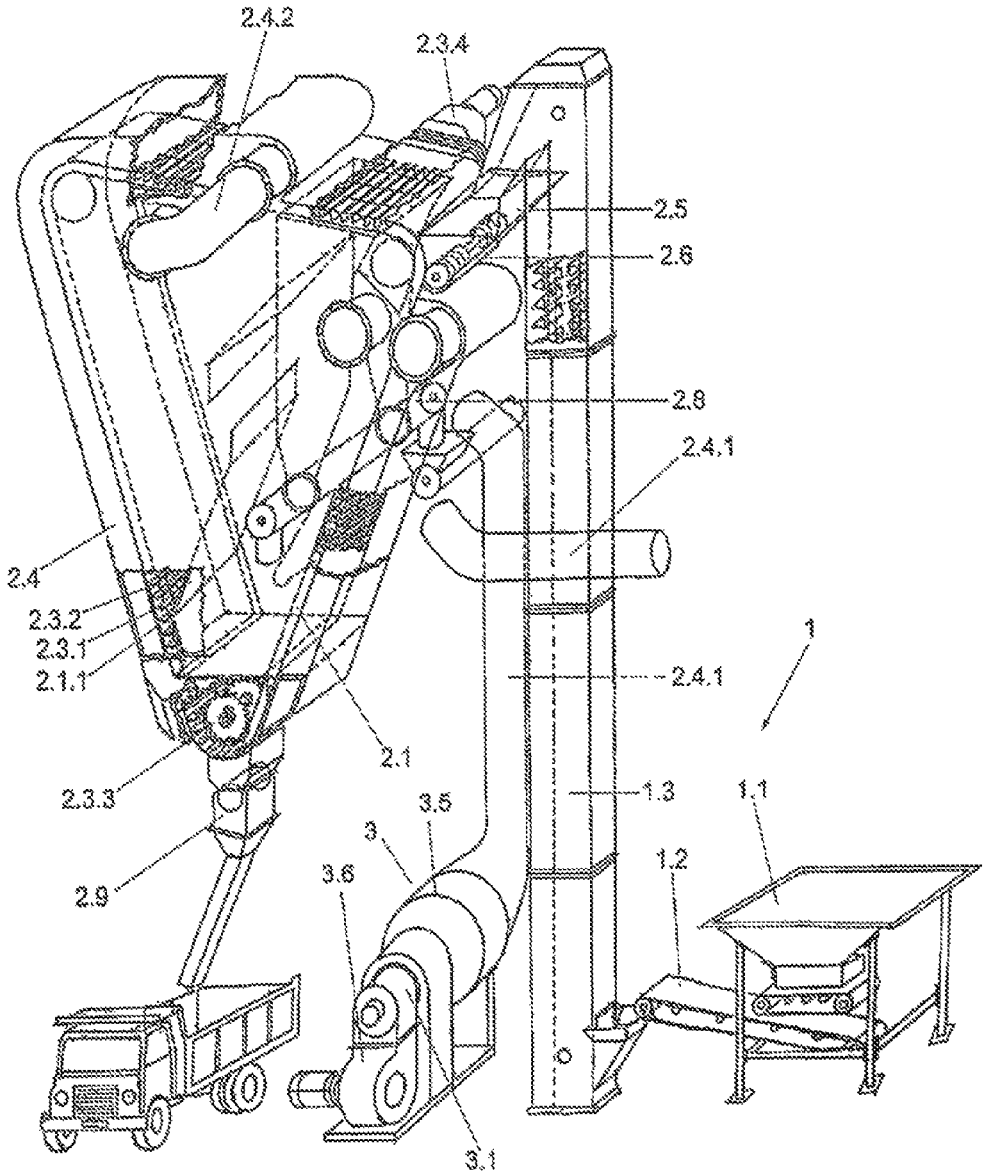
FIG. 2 gives a perspective view of the subject hot mix asphalt recycling system.
Figure 3:
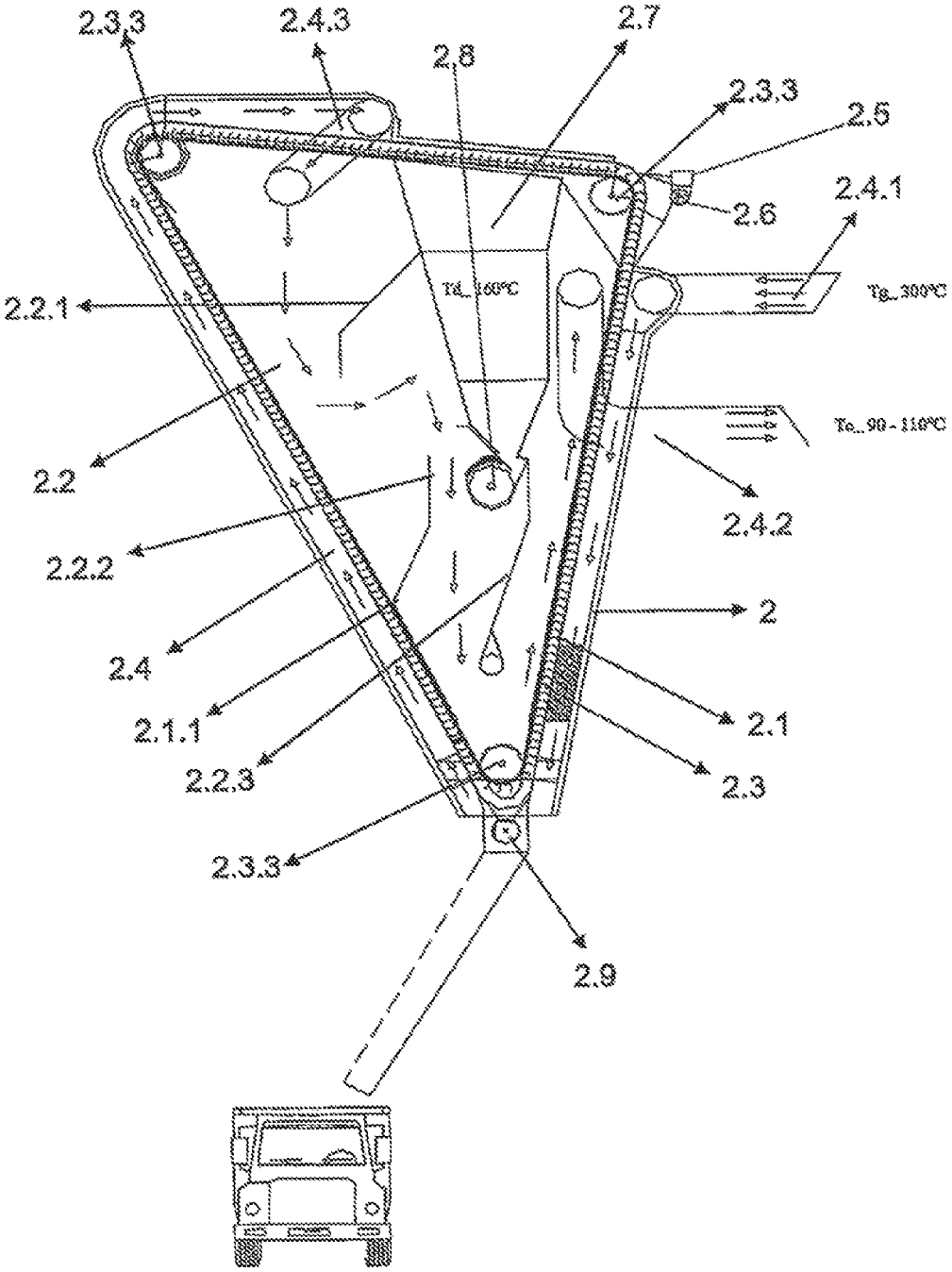
FIG. 3 gives a cross-sectional view of the hot air flow within the subject hot mix asphalt recycling system.

As illustrated in FIGS. 2 and 3, the subject hot mix asphalt recycling system is composed of a material loading unit (1) consisting of one or more silo(s) (1.1), band conveyor (1.2), and an vertical bucket elevator unit (1.3); a frame (2) that is insulated to avoid temperature fall and is composed of a RAP material transmission channel (2.1) embodied on and in said frame (2), a hot air reservoir (2.2), transmission line (2.3), air circulation channel (2.4), RAP material feeding reservoir (2.5), RAP material feeding mechanism (2.6), RAP material accumulation reservoir (2.7), RAP material discharge mechanism (2.8), and RAP material discharge mechanism (2.8) at said transmission channel (2.1); legs (not shown in the Figure) supporting said frame (2); and a hot air feeding mechanism (2.6) consisting of a pre-combustion chamber (3.5) and a boiler (3.1). The frame (2), transmission channel (2.1) and the hot air circulation channel (2.4) have right triangle-like formations so as to fit to each other.

Referring back to FIGS. 2 and 3, said hot air reservoir (2.2) formed on the frame (2) comprises an upper guiding wing (2.2.1), a central guiding wing (2.2.2), and a lower guiding wing (2.2.3). Additionally, said transmission line (2.3) comprises a plurality of transmission plates (2.3.1) embodied with an L-like shape whereon RAP material is conveyed. The drive of said transmission line (2.3) is ensured by means of a actuation mechanism comprising a plurality of chains (2.3.2) which have connection with said transmission line (2.3) and extend parallel to each other; a plurality of chain gears (2.3.3) which are engaged to said chains (2.3.2) and positioned preferably at each corner of said triangular formation, and an electric motor and reducer (2.3.4).

Said hot air circulation channel (2.4) comprises an air inlet pipe (2.4.1) which provides the inlet of hot air into the hot air circulation channel (2.4) said hot air obtained in the pre-combustion chamber (3.5) by means of the heat acquired from the boiler (3.1); a polluted air outlet pipe (2.4.2) that outlets the circulated hot air out of the system and passes it to the filter; and an intermediary transfer pipe (2.4.3.) or elbow transferring the air within the hot air circulation channel (2.4) to the hot air reservoir (2.2).

The transmission line (2.3) is positioned in the transmission channel (2.1) with a cavity of determined sizes that will advance the RAP material so as to remain between the plates (2.3.1) within the transmission plates (2.3.1) and transmission channel (2.1), will not let the RAP material flow through between the wall and plates and will avoid this material from becoming jammed therein, and will prevent the plates (2.3.1) from coating the wall and the RAP material from becoming adhered to the wall. In this manner, the asphalt material shall be advanced by said transmission plates (2.3.1) without adhering to the walls until the desired temperature is reached.

The transmission channel (2.1) is fully closed along the perpendicular line (i.e. cathetus, or the leg) of the triangle whereon the transmission line (2.3) starting from the feeding point advances downwards, wherein the heat to be transferred to RAP material within the transmission channel (2.1) is achieved by means of contacting the hot channel surface. Along this line, the temperature of RAP material is not increased yet so that no adhering starts to occur at the channel wall. Therefore, the transmission plates (2.3.1) having open L-shaped profiles are coupled to the chains (2.3.2) in a way that the open side thereof faces downwards.

The transmission channel (2.1) is opened from the inner side in order to easily discharge the RAP material, which is transferred by means of the transmission line (2.3) and plates (2.3.1) within the transfer channel (2.1) and thus heated to desired temperature, into the RAP material accumulation reservoir (2.7)

Accordingly, there are two types of flows available within the system. The first one involves the displacement of bitumen-containing asphalt material to be recycled within the hot air asphalt recycling system. And the second one involves the flow of hot air aiming to heat the displacing bitumen-containing asphalt material within the system to a temperature that is proper for feeding into the asphalt plant (5) used for asphalt production.

In the first flow, the RAP material is loaded to the system by means of a material loading unit (1), since the system is positioned high above from the ground. In this case, the asphalt material to be recycled is first discharged to a silo (1.1), transferred from this silo to a vertical bucket elevator unit (1.3) by means of a band conveyor (1.2), and then transferred from an inlet into the feeding reservoir (2.5) according to the present invention. RAP material accumulated within the asphalt feeding reservoir (2.5) is transferred to transmission plates (2.3.1) on the transmission line (2.3) by means of a feeding mechanism (2.6), which actually is a whorl conveyor provided underneath the feeding reservoir (2.5).

Meanwhile, hot air provided from the hot air generation mechanism (3) at the hot air feeding mechanism (2.6) is transferred from the air inlet pipe (2.4.1) to the air circulation channel (2.4) and is advanced as indicated by arrows in FIG. 3. Thanks to embodying the air circulation channel (2.4) around the transmission channel (2.1) in the form of an air jacket, the heating process starts with supplying the RAP material to the transmission line (2.3) from the feeding mechanism (2.6).

The part of the transmission channel (2.1) at the longer edge, where the transmission line (2.3) bends from the lower corner and starts advancing upwards as beginning from the enlarging point (2.1.1) at vicinity of the central guiding wing (2.2.2), is made open, thereby hot air is directly contacted to the RAP material between the transmission plates (2.3.1) and a more rapid heat transfer ensured. Along this line, the temperature of RAP material is raised so that it starts adhering to the channel wall. Therefore, the open sides of transmission plates (2.3.1) with open L-shaped profiles are turned upwards with respect to their coupling manner on the chains (2.3.2) so that transmission plates (2.3.1) carry the RAP material upwardly more effectively by contacting the channel wall RAP material to fall downward for any reason from between the plates is diverted back to the transmission plates (2.3.1) by means of the central guiding wing (2.2.2). The transmission channel (2.1) is closed back by the inner surface before it reaches the point where the chain gears (2.3.3) are provided at the corner turning to the feeding unit. Thus the possibility is avoided that the RAP material between the transmission plates (2.3.1) falls downward into the hot air reservoir (2.2).

The air circulation channel (2.4) is ended right after the upper chain gears (2.3.3) above the hypotenuse. Hot air arriving here is supplied to the hot air reservoir (2.2) by means of an intermediary transfer pipe (2.4.3) and is guided directly on the asphalt material within the transmission plates (2.3.1) on the transmission line (2.3) by means of the upper guiding wing (2.2.1). Air contacting the RAP material and becoming polluted as result of emerging gases and steam is guided by means of the central guiding wing (2.2.2) and advanced to the outlet. Polluted air is passed through a filter system (not shown in figures) under the suction affect of air suction equipments (not shown in figures) once they start operating. The polluted air is filtered here and then released to the atmosphere.

The material is displaced horizontally downstream the chain gears (2.3.3) at the upper corner with the transmission line (2.3) continuing its displacement, and when it arrives the RAP material accumulation reservoir (2.7) heated to the desired temperature (preferably 160° C. in this example) by means of hot air circulated within the system, it is poured into this RAP material accumulation reservoir (2.7) through an opening arranged thereat. Hot RAP material accumulated within the RAP material accumulation reservoir (2.7) is then transferred to the mixer (5.1) at the asphalt plant (5) by means of the RAP material discharge mechanism (2.8), which actually is a whorl conveyor. It is hereby aimed to use such RAP material in producing new asphalt by mixing it to a new mix being prepared in said mixer (5.1).

According to all information given above, if any obstruction occurs due to material flow within the system, the system is operated idly (i.e. without load) to eliminate such obstruction.

Additionally, any RAP material to accumulate at the lower corner can be discharged by opening the shutters in the discharge unit (2.9) provided at the lower corner of the frame (2).

In an alternative embodiment of the present invention, resistor systems (i.e. heating coils) may be used in the role of said heating mechanism to be positioned on the frame (2) and preferably along the transmission channel (2.1).

In a further alternative embodiment of the present invention, heat exchanger systems may be used in the role of said heating mechanism to be positioned on the frame (2) and preferably along the transmission channel (2.1), said exchanger system transferring the heat of fluid circulating in itself to the asphalt material.

In another preferred embodiment of the present invention, a proper conveyor system may be employed in the role of said vertical bucket elevator unit (1.3) within the feeding unit (1).

A further feature aimed according to the present invention to be adapted to the foregoing main structure is to adjust the temperature of air circulated within the channel for heating the RAP material over a large interval.

Figure 4A:
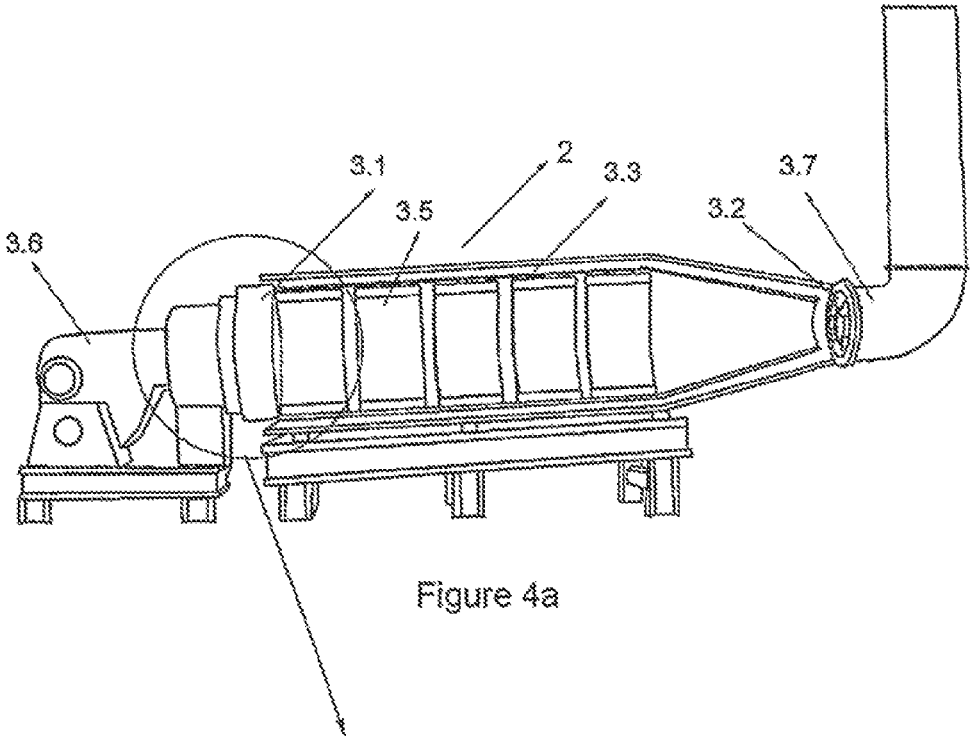
FIG. 4*a* gives a side view of the boiler mechanism used in the present invention.
Figure 4B:
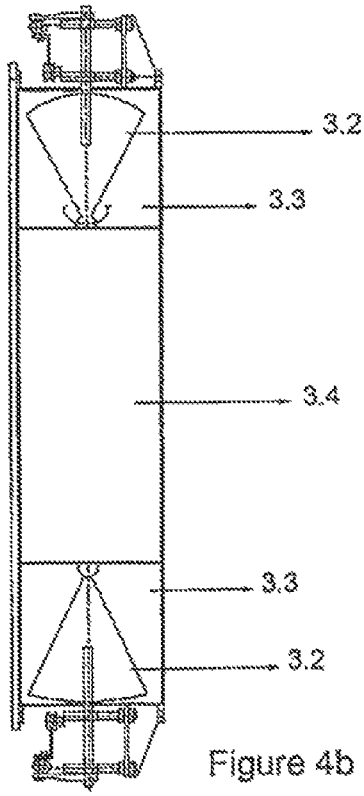
FIG. 4*b* is a cross-sectional view of the air adjustment shutter used in the present invention.

Accordingly, as illustrated in FIGS. 4*a* and 4*b*, hot air generation is provided by means of a boiler (3.1) according to the present invention. Here, the heat generated by the boiler's flame increase the temperature of air within the pre-combustion chamber (3.5) and is canalized to the hot air channel (3.4) by means of a fan (3.6). Air adjustment flaps (3.2) are embodied here, to adjust the temperature of hot air generated in the pre-combustion chamber (3.5) by mixing it with cold air at the hot air inlet channel (3.7). Said small air adjustment flaps (3.2) are composed of a plurality of wing-like small air adjustment flaps (3.2), which are arranged along the inner wall of the cold air channel (3.3) and rotate around a plurality of connection axes so as to narrow and enlarge the channel. Thanks to this feature, cold air is supplied to the air circulation channel (2.4) from between said small air adjustment flaps (3.2) so that the temperature of air circulating within the channel is dropped once it becomes mixed with hot air. The opening and closing of said small air adjustment flaps (3.2), their opening and closing times and/or their open time is controlled by means of an automation system. Here, the user enters into the automation system the temperature value he/she aims within the channel, such that said small air adjustment flaps (3.2) are opened or closed for allowing cold air entrance until such aimed temperature level is reached by means of said automation system. In alternative embodiments of the present invention, any other flap embodiment may take please said small flaps, as long as the function of narrowing/enlarging the channel is fulfilled. Although not recommended, said small air adjustment flaps (3.2) may also be controlled manually.

In result, thanks to this revision put forth in the previous paragraph, as the amount of heat to be transferred is altered, the temperature of air circulated within the air circulation channels (2.4) in the frame (2) and the amount of air is altered so that a required amount of heat energy is obtained. In other words, before the hot air obtained within the pre-combustion chamber (3.5) enters into the hot air inlet channel (3.7) of the frame (2), it is mixed with cold air which is received via cold air channel (3.3) and whose amount is controlled by the cold air inlet flap. As the small air adjustment flaps (3.2) at the cold air inlet are opened/closed, they enlarge/narrow the cross-section of said cold air channel (3.3). Thanks to this feature, since the cold air inlet will occur at a lower flow rate with the cross-section narrowing, the temperature of air mixture entering into the hot air inlet channel (3.7) of the frame is raised, and since the cold air inlet will occur at a higher flow rate with the cross-section enlarging, the temperature of air mixture entering into the channel is dropped. Thus, the system is operated more efficiently.

A further feature aimed within the present invention is to accurately control the RAP material's discharge and the output amount of RAP material to the exterior.

Figure 5:
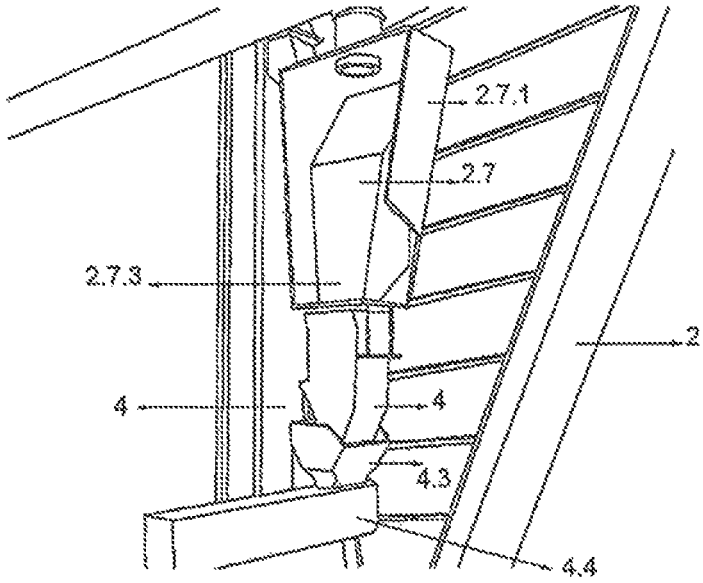
FIG. 5 is a perspective view of the RAP material weighing mechanism used in the present invention.
Figure 6:
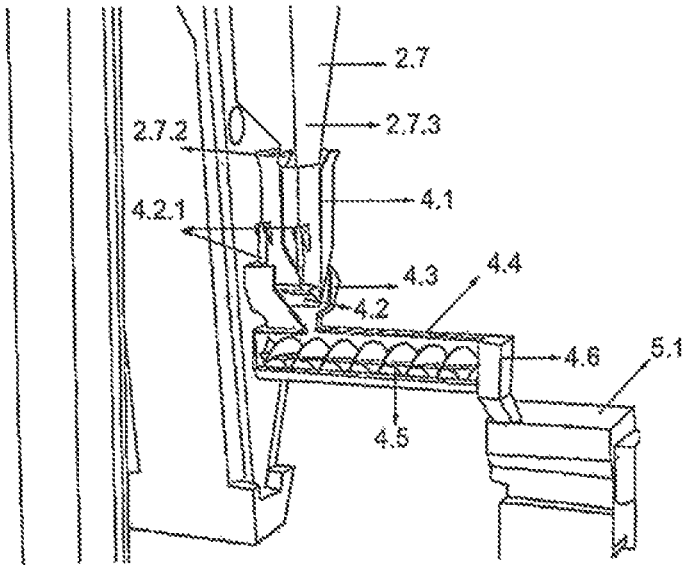
FIG. 6 is a perspective view of the RAP material discharge mechanism used in the present invention.

Accordingly, as illustrated in FIGS. 5 and 6, the RAP material accumulation reservoir (2.7) according to the present invention is preferably embodied on the lateral surface of the heat-insulated frame (2) facing the asphalt plant (5), so as to project partially outward from the frame (2) towards the side of the mixer (5.1). Accordingly, a protective surface (2.7.1) (i.e. hot air jacket) is embodied on said projecting part to enclose it all around to maintain its temperature, so that when hot air is circulated within this air jacket, heat losses are avoided. As illustrated in FIG. 6, a material discharge outlet (2.7.3) is embodied on the lower end of the outward-projecting part of said RAP material accumulation reservoir (2.7), this discharge outlet (2.7.3) being opened/closed by means of a discharge outlet shutter (2.7.2) controlled by an automation system.

Referring back to FIGS. 5 and 6, the inlet portion of RAP material weighing mechanism (4) according to the present invention comprises a discharge reservoir (4.1) connected to the frame (2) so as to become aligned with said discharge outlet (2.7.3) vertically. A discharge shutter (4.2) is embodied at the discharge section of said discharge reservoir (4.1) and this discharge shutter (4.2) is controlled by means of weight sensors (not shown in the Figure) measuring the weight of asphalt filled into the discharge reservoir (4.1). The opening/closing of the discharge shutter (4.2) is conducted by means of shutter pistons (4.2.1). A funnel-like transfer surface (4.3) is provided at the lower end of the discharge reservoir (4.1). When the discharge shutter (4.2) is opened, the released asphalt is properly guided by means of this transfer surface (4.3) to the whorl cylinder (4.5) which is extended horizontally. Said whorl cylinder (4.5) is positioned within a whorl cylinder frame (4.4), which is preferably single-piece with the transfer surface (4.3) and extends perpendicularly to this surface. The outlet of the whorl cylinder (4.5) is opened to the mixer (5.1) via a cylinder discharge outlet (4.6).

In brief, thanks to said RAP material discharge mechanism (2.8) referred to above as the material weighing means, the RAP material to be transferred into the mixer (5.1) is passed to a weight sensor (load-cell) from the discharge outlet shutter (2.7.2) at the discharge outlet (2.7.3) so that the weight of RAP material is controlled, and once any desired amount of RAP material is taken, the discharge outlet shutter (2.7.2) is closed, and the material is supplied from the discharge reservoir (4.1) to the new mix in the mixer (5.1) by means of the whorl cylinder (4.5), ensuring a very efficient and controlled conversion of RAP to RAC.

The protection scope of the present invention is set forth in the annexed Claims and cannot be restricted to the illustrative disclosures given above, under the detailed description. It is because a person skilled in the relevant art can obviously produce similar embodiments under the light of the foregoing disclosures, without departing from the main principles of the present invention.

The invention claimed is:

1. A hot asphalt recycling system for adding any used and then ripped asphalt from its original place into new asphalt production, having a heat-insulated frame with a closed volume; at least one RAP material transmission channel within said frame, said channel being embodied so as to produce a geometrical shape with at least three edges; a transmission line displacing within said RAP material transmission channel and comprising a plurality of transmission plates positioned thereon at certain intervals and whereon RAP material is conveyed; optionally a feeding mechanism feeding RAP material to the transmission line; heating means used to heat the RAP material in the transmission line up to a certain temperature; optionally a RAP material discharge mechanism providing the transfer of accumulated hot RAP material to a desired means; wherein said heating means comprise a hot air circulation channel surrounding the transmission channel from the interior and/or exterior, and a hot air generation mechanism used for providing hot air to be circulated at a desired flow rate and speed within said hot air circulation channel, the transmission channel and accordingly the hot air circulation channel have a right-angled triangle-like form and said system comprising an actuation mechanism to displace the transmission line at a certain speed; an accumulation reservoir formed within the frame to store the RAP material heated to a certain temperature without causing any temperature fall; and optionally a discharge unit to discharge the RAP material within the transmission channel to the exterior when it becomes necessary.

2. An asphalt recycling system according to claim 1, wherein said hot air generation mechanism further comprises a pre-combustion chamber, fan, and a boiler.

3. An asphalt recycling system according to claim 1, wherein said hot air generation mechanism comprises cold air supplying means in order to control the temperature of generated hot air.

4. An asphalt recycling system according to claim 3, wherein said cold air supplying means is a flap, which is placed at the inlet of the hot air channel, is opened and closed so as to increase/decrease the cross-section of said cold air inlet channel, and is composed of a plurality small flaps.

5. An asphalt recycling system according to claim 4, wherein said small flaps are in the form of wings disposed in sequence along the inner wall of said cold air inlet channel so as to narrow and enlarge the channel by rotating around multiple connection axes.

6. An asphalt recycling system according to claim 4, wherein the opening/closing of said small flaps is controlled by means of an automation system.

7. An asphalt recycling system according to claim 1, further comprising a hot air reservoir formed at the zone of the hypotenuse border of the transmission channel comprises, so that the hot air having completed the circulation within the hot air channel is supplied into said reservoir.

8. An asphalt recycling system according to claim 7, wherein said hot air reservoir comprises a plurality of small guiding wings that lengthen the way to be traveled by hot air within the hot air reservoir so that heat transfer is provided to the transmission channel and the RAP material accumulation reservoir and that divert the hot air becoming polluted with the emerging steam and gases to the air outlet pipe.

9. An asphalt recycling system according to claim 8, wherein an aspiration system and filter are provided at the end of the channel in order to safely release to the atmosphere the hot air which becomes polluted due to steam and gases emerging as a result of heat within said hot air reservoir, and then is canalized to the air outlet pipe by means of guiding wings.

10. An asphalt recycling system according to claim 1, wherein a whorl cylinder is employed in the role of said feeding mechanism.

11. An asphalt recycling system according to claim 1, wherein said actuation mechanism comprises at least one electric motor and reducer and a plurality of chain gears coupled to said motor and reducer and a plurality of chains which are rotated by means of these chain gears and positioned so as to rotate in turn within the transmission line.

12. An asphalt recycling system according to claim 1, wherein a whorl cylinder is employed in the role of said discharge mechanism and optionally, a discharge shutter is used which is embodied at the base of said accumulation reservoir.

13. An asphalt recycling system according to claim 1 wherein said RAP material discharge mechanism comprises weighing means equipped with weight sensors in order to ensure the addition of processed RAP material within the system into the new mix at a desired proportion.

14. An asphalt recycling system according to claim 13, wherein said weighing means comprises at least one discharge outlet wherein hot RAP material output from the material accumulation reservoir is discharged, weight sensors measuring the weight of the material filled into said discharge outlet, closing means closing the discharge shutter once the material is discharged and weighed to a desired weight, and a whorl cylinder to transfer the material released from the discharge shutter to the mixer.

15. An asphalt recycling system according to claim 14, wherein said material accumulation reservoir is embodied so as to make an outward projection from one side of said frame so that the reservoir's discharge outlet becomes aligned with said discharge reservoir.

16. An asphalt recycling system according to claim 15, wherein a hot air channel is provided which is embodied in an insulated manner so as to adequately envelop the outward projecting part of the reservoir from the exterior in order to avoid any temperature drop in the accumulation reservoir.

17. An asphalt recycling system according to claim 1, wherein said frame has a right-angled triangle-like form in line with the forms of the transmission channel and the hot air circulation channel.

18. An asphalt recycling system according to claim 1, wherein said frame comprises support legs to transfer hot RAP material output from the RAP material discharge mechanism to an asphalt mixer.

19. An asphalt recycling system according to claim 1, wherein the RAP material to be recycled for addition into a new mix is conveyed to said feeding mechanism by means of a vertical bucket elevator.

20. An asphalt recycling system according to claim 1, wherein said RAP material discharge mechanism comprises at least one shutter positioned at the lowermost point of the transmission channel and an optional whorl cylinder, in order to discharge for any reason any processed asphalt before arriving the accumulation reservoir.

* * * * *